US009113253B2

(12) United States Patent
Yoshida

(10) Patent No.: US 9,113,253 B2
(45) Date of Patent: Aug. 18, 2015

(54) HEADPHONE DEVICE

(71) Applicant: SONY CORPORATION, Tokyo (JP)

(72) Inventor: Shigeru Yoshida, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/394,821

(22) PCT Filed: Mar. 27, 2013

(86) PCT No.: PCT/JP2013/002074
§ 371 (c)(1),
(2) Date: Oct. 16, 2014

(87) PCT Pub. No.: WO2013/175694
PCT Pub. Date: Nov. 28, 2013

(65) Prior Publication Data

US 2015/0063623 A1 Mar. 5, 2015

(30) Foreign Application Priority Data

May 21, 2012 (JP) ..... 2012-115840

(51) Int. Cl.
*H04R 25/00* (2006.01)
*H04R 1/10* (2006.01)

(52) U.S. Cl.
CPC ..... *H04R 1/10* (2013.01); *H04R 2201/10* (2013.01)

(58) Field of Classification Search
CPC .... H04R 1/1008; H04R 1/1016; H04R 1/105; H04R 1/1033; H04R 1/1066; H04R 5/033; H04R 5/0335; H04R 25/60; H04R 25/65; H04R 25/652; H04R 2201/107; H04R 2225/021; H04R 2225/63
USPC ..... 381/370, 371, 374, 376–379
See application file for complete search history.

(56) References Cited

U.S. PATENT DOCUMENTS

| | | | | |
|---|---|---|---|---|
| 3,875,592 | A * | 4/1975 | Aileo | 2/209 |
| 4,058,688 | A * | 11/1977 | Nishimura et al. | 381/370 |
| 2012/0070027 | A1 * | 3/2012 | Ridler | 381/374 |

FOREIGN PATENT DOCUMENTS

| | | | |
|---|---|---|---|
| JP | S57-138489 | U | 8/1982 |
| JP | H03-128392 | U | 12/1991 |
| JP | H10-271591 | A | 10/1998 |
| JP | 2009-290621 | A | 12/2010 |
| JP | 3165555 | U | 1/2011 |

* cited by examiner

*Primary Examiner* — Brian Ensey
(74) *Attorney, Agent, or Firm* — Sony Corporation

(57) ABSTRACT

A simple structure that is easy to store is to be formed, and portability of the structure is to be increased.
The structure includes: a headband to be mounted on a head; and a pair of speaker units detachably attached to the headband, wherein a suction portion is formed in the headband, a to-be-sucked portion to be sucked into the suction portion by a magnetic force from a magnet is formed in the speaker units, and one of the suction portion and the to-be-sucked portion is longer in shape than the other one. With this configuration, the structure is simplified and is made easier to store, and accordingly, portability of the structure can be increased.

10 Claims, 12 Drawing Sheets

HEADPHONE DEVICE

TECHNICAL FIELD

The present technique relates to the technical field of headphone devices. More particularly, the present technique relates to the technical field for simplifying a structure, making the structure easier to store, and increasing the portability of the structure by detachably attaching speaker units to a headband by virtue of a magnetic force from a magnet.

BACKGROUND ART

There have been headphone devices each including a headband and a pair of speaker units joined to the respective end portions of the headband.

Among such headphone devices, there is a type of headphone device that can adjust the positions of the speaker units relative to the headband in accordance with the positions of the ears relative to the face, the size of the face, and the like (see Patent Document 1, for example).

In the headphone device disclosed in Patent Document 1, the headband has an expansion/contraction mechanism, and the headband expands and contracts to move the speaker units to the positions suitable for the ears of the user.

The expansion/contraction mechanism is formed with rollers, a cover for the headband, a stopper for maintaining a position determined as a result of expansion or contraction, and the like.

CITATION LIST

Patent Document

Patent Document 1: JP 10-271591 A

SUMMARY OF THE INVENTION

Problems to be Solved by the Invention

In the headphone device disclosed in Patent Document 1, however, the expansion/contraction mechanism formed in the headband includes a large number of components as described above, and the large number of components result in a complicated structure.

Also, as the speaker units are joined to the headband, the headphone device takes up much space in a bag or the like, and is not easy to store or carry around.

Therefore, a headphone device according to the present technique is to increase portability by having a simpler structure and becoming easier to store.

Solutions to Problems

In a first aspect, a headphone device includes: a headband to be mounted on a head; and a pair of speaker units detachably attached to the headband, wherein a suction portion is formed in the headband, a to-be-sucked portion to be sucked into the suction portion by a magnetic force from a magnet is formed in the speaker units, and one of the suction portion and the to-be-sucked portion is longer in shape than the other one.

Accordingly, in the headphone device, the to-be-sucked portion is sucked into the suction portion by a magnetic force from the magnet, and, when not being used, the speaker units can be detached from the headband.

In a second aspect of the headphone device, the suction portion is preferably longer in shape than the to-be-sucked portion, and the suction portion is preferably designed to extend in the longitudinal direction of the headband.

Since the suction portion is longer in shape than the to-be-sucked portion, and the suction portion is designed to extend in the longitudinal direction of the headband, the longitudinal direction of the headband and the longitudinal direction of the suction portion are aligned.

In a third aspect of the headphone device, one of the suction portion and the to-be-sucked portion is preferably formed in a convex shape, and the other one of the suction portion and the to-be-sucked portion is preferably formed in a concave shape.

Since one of the suction portion and the to-be-sucked portion is formed in a convex shape while the other one is formed in a concave shape, the one of the suction portion and the to-be-sucked portion formed in a convex shape is inserted into the other one of the suction portion and the to-be-sucked portion formed in a concave shape so that the suction portion and the to-be-sucked portion are joined together.

In a fourth aspect of the headphone device, the to-be-sucked portion is preferably formed in a convex shape, and the suction portion is preferably formed in a concave shape.

Since the to-be-sucked portion is formed in a convex shape while the suction portion is formed in a concave shape, the to-be-sucked portion formed in a convex shape is inserted into the suction portion formed in a concave shape so that the suction portion and the to-be-sucked portion are joined together.

In a fifth aspect of the headphone device, the magnet is preferably formed in a spherical shape, and the largest magnetic force generating point in the magnet is preferably located at a portion other than the center of the magnet.

Since the magnet is formed in a spherical shape, and the largest magnetic force generating point in the magnet is located at a portion other than the center of the magnet, the orientation of the speaker units with respect to the headband changes with the rotational position of the magnet.

In a sixth aspect of the headphone device, the magnet is preferably attached to the to-be-sucked portion.

Since the magnet is attached to the to-be-sucked portion, the magnet is attached to the to-be-sucked portion formed in a convex shape.

In a seventh aspect of the headphone device, a positioning convex portion is preferably formed in one of the suction portion and the to-be-sucked portion, and a positioning concave portion into which the positioning convex portion is to be inserted is preferably formed in the other one of the suction portion and the to-be-sucked portion.

Since a positioning convex portion is formed in one of the suction portion and the to-be-sucked portion while a positioning concave portion is formed in the other one of the suction portion and the to-be-sucked portion, the positioning convex portion is inserted into the positioning concave portion so that the to-be-sucked portion is sucked into the suction portion.

In an eighth aspect of the headphone device, positioning concave portions are preferably formed in one of the suction portion and the to-be-sucked portion and are preferably arranged in the longitudinal direction, the one of the suction portion and the to-be-sucked portion being long in shape.

Since positioning concave portions are formed in one of the suction portion and the to-be-sucked portion, which is long in shape, and are arranged in the longitudinal direction, the positioning convex portion is inserted into one of the positioning concave portions arranged in the longitudinal direction so that the to-be-sucked portion is sucked into the suction portion.

In a ninth aspect of the headphone device, positioning convex portions are preferably formed, and the positioning convex portions are preferably inserted into the positioning concave portion.

Since positioning convex portions are formed and are inserted into the positioning concave portion, the speaker units do not rotate with respect to the headband.

In a tenth aspect of the headphone device, a to-be-sucked surface portion is preferably formed in a portion other than the positioning convex portion in one of the suction portion and the to-be-sucked portion, and a suction surface portion to be brought into contact with the to-be-sucked surface portion is preferably formed in a portion other than the positioning concave portion in the other one of the suction portion and the to-be-sucked portion.

Since a to-be-sucked surface portion is formed in a portion other than the positioning convex portion in one of the suction portion and the to-be-sucked portion, and a suction surface portion to be brought into contact with the to-be-sucked surface portion is formed in a portion other than the positioning concave portion in the other one of the suction portion and the to-be-sucked portion, the to-be-sucked surface portion is sucked to the suction surface portion in a surface contact state.

Effects of the Invention

A headphone device according to the present technique includes: a headband to be mounted on a head; and a pair of speaker units detachably attached to the headband, wherein a suction portion is formed in the headband, a to-be-sucked portion to be sucked into the suction portion by a magnetic force from a magnet is formed in the speaker units, and one of the suction portion and the to-be-sucked portion is longer in shape than the other one.

Accordingly, the structure can be simplified and be made easier to store, and portability of the structure can be increased.

In the technique disclosed in claim 2, the suction portion is longer in shape than the to-be-sucked portion, and the suction portion is designed to extend in the longitudinal direction of the headband.

Accordingly, the longitudinal direction of the headband formed to have a long shape beforehand is aligned with the longitudinal direction of the suction portion, so that the suction portion can be formed without an increase in the size of the headphone device.

In the technique disclosed in claim 3, one of the suction portion and the to-be-sucked portion is formed in a convex shape, and the other one of the suction portion and the to-be-sucked portion is formed in a concave shape.

Accordingly, the suction portion and the to-be-sucked portion joined together form a thin portion, and a stable connected state between the headband and the speaker unit can be secured.

In the technique disclosed in claim 4, the to-be-sucked portion is formed in a convex shape, and the suction portion is formed in a concave shape.

Accordingly, the headband can be certainly made thinner.

In the technique disclosed in claim 5, the magnet is formed in a spherical shape, and the largest magnetic force generating point in the magnet is located at a portion other than the center of the magnet.

Accordingly, the speaker units can be finely adjusted in accordance with the shape and the size of the head of the user and the positions of the ears relative to the head of the user, and user-friendliness can be further increased.

In the technique disclosed in claim 6, the magnet is attached to the to-be-sucked portion.

Accordingly, sufficient installation space can be secured for the magnet, and the headband can be made thinner.

In the technique disclosed in claim 7, at least one positioning convex portion is formed in one of the suction portion and the to-be-sucked portion, and at least one positioning concave portion into which the at least one positioning convex portion is to be inserted is formed in the other one of the suction portion and the to-be-sucked portion.

Accordingly, stable positioning and connection of the speaker units to the headband can be secured.

In the technique disclosed in claim 8, the at least one positioning concave portion includes positioning concave portions, and the positioning concave portions are formed in one of the suction portion and the to-be-sucked portion and are arranged in a longitudinal direction, the one of the suction portion and the to-be-sucked portion being long in shape.

Accordingly, the position of the to-be-sucked portion can be adjusted in the longitudinal direction while the to-be-sucked portion is positioned to the suction portions, and the user-friendliness of the headphone device can be increased.

In the technique disclosed in claim 9, the at least one positioning convex portion includes positioning convex portions, and the positioning convex portions are inserted into the at least one positioning concave portion.

Accordingly, the speaker units do not rotate with respect to the headband, and the connection and the positioning between them can be stabilized.

In the technique disclosed in claim 10, a to-be-sucked surface portion is formed in a portion other than the at least one positioning convex portion in one of the suction portion and the to-be-sucked portion, and a suction surface portion to be brought into contact with the to-be-sucked surface portion is formed in a portion other than the at least one positioning concave portion in the other one of the suction portion and the to-be-sucked portion.

Accordingly, the suction force of the suction portion for the to-be-sucked portion becomes larger, and the connection and the positioning between the two portions can be stabilized.

MODES FOR CARRYING OUT THE INVENTION

The following is a description of preferred modes for carrying out the present technique, with reference to the accompanying drawings.

[Structure of a Headphone Device]

Figure 1:
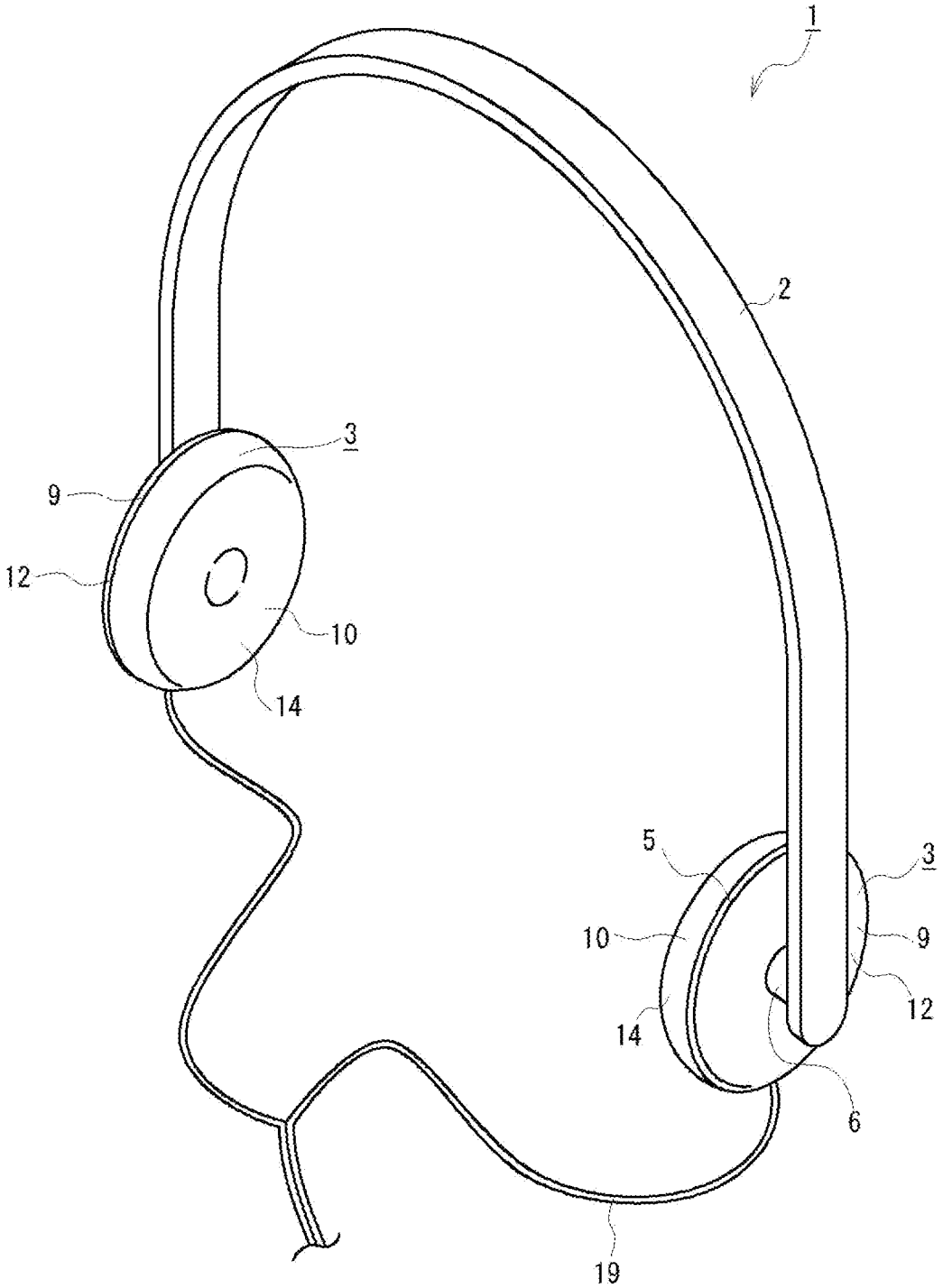
FIG. 1 is a perspective view of a headphone device according to the present technique, showing the headphone device in conjunction with FIGS. 2 through 16.

A headphone device 1 includes a headband 2 and a pair of speaker units 3 detachably attached to the headband 2 (FIG. 1).

The headband 2 is mounted on the head of the user, and is designed to be thin and substantially U-shaped. The headband 2 can be elastically deformed to bend in the thickness direction, and is mounted on the head in such a manner that one of the surfaces in the thickness direction is in contact with the head. Concave suction portions 4 are formed in the inner surfaces of both end portions of the headband 2 in the longitudinal direction (see FIGS. 2 and 3).

The suction portions 4 are designed to extend in the longitudinal direction of the headband 2. The suction portions 4 are made of a magnetic material such as iron, and each have spherical end portions 4*a* on both sides in the longitudinal direction. The portion of each of the suction portions 4 minus the end portions 4*a* is formed as an intermediate portion 4*b*, and the intermediate portion 4*b* is designed to have an arc-like shape in the width direction (the short-side direction).

Figure 2:
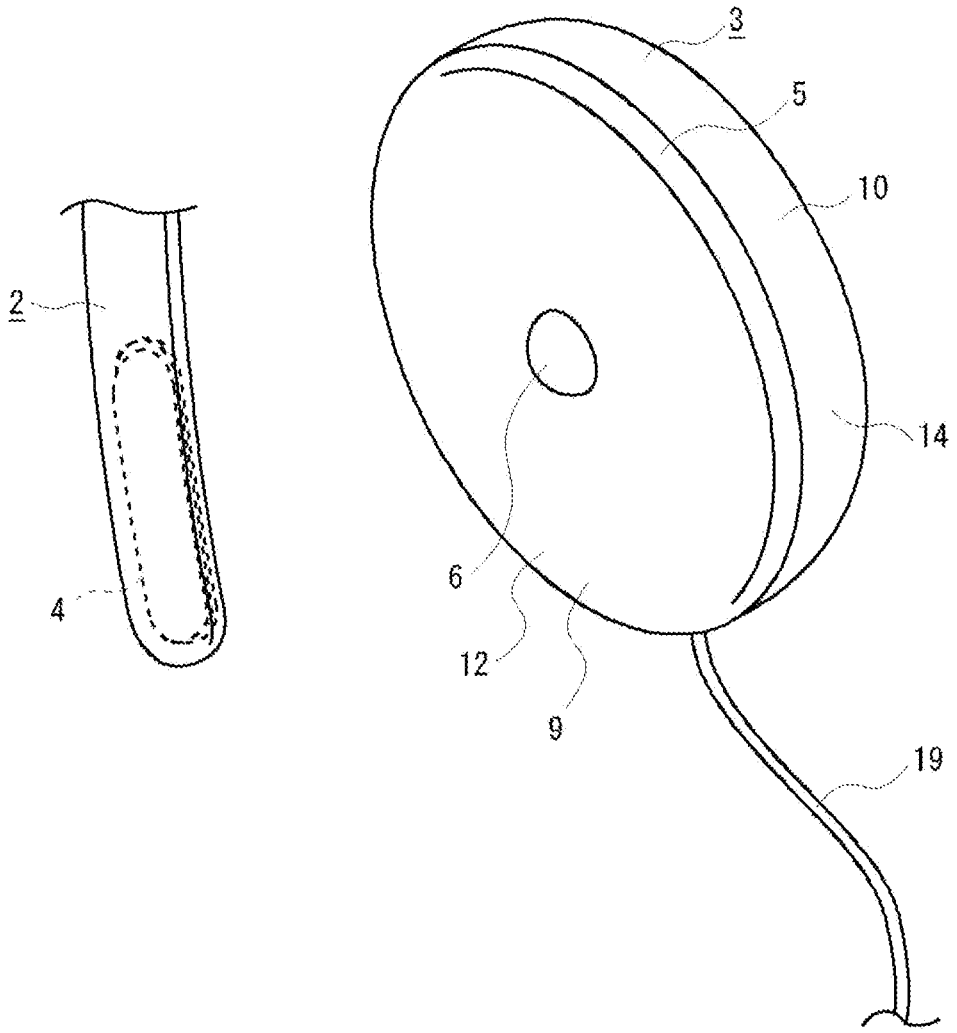
FIG. 2 is a perspective view of a headband and a speaker unit that are separated from each other.
Figure 3:
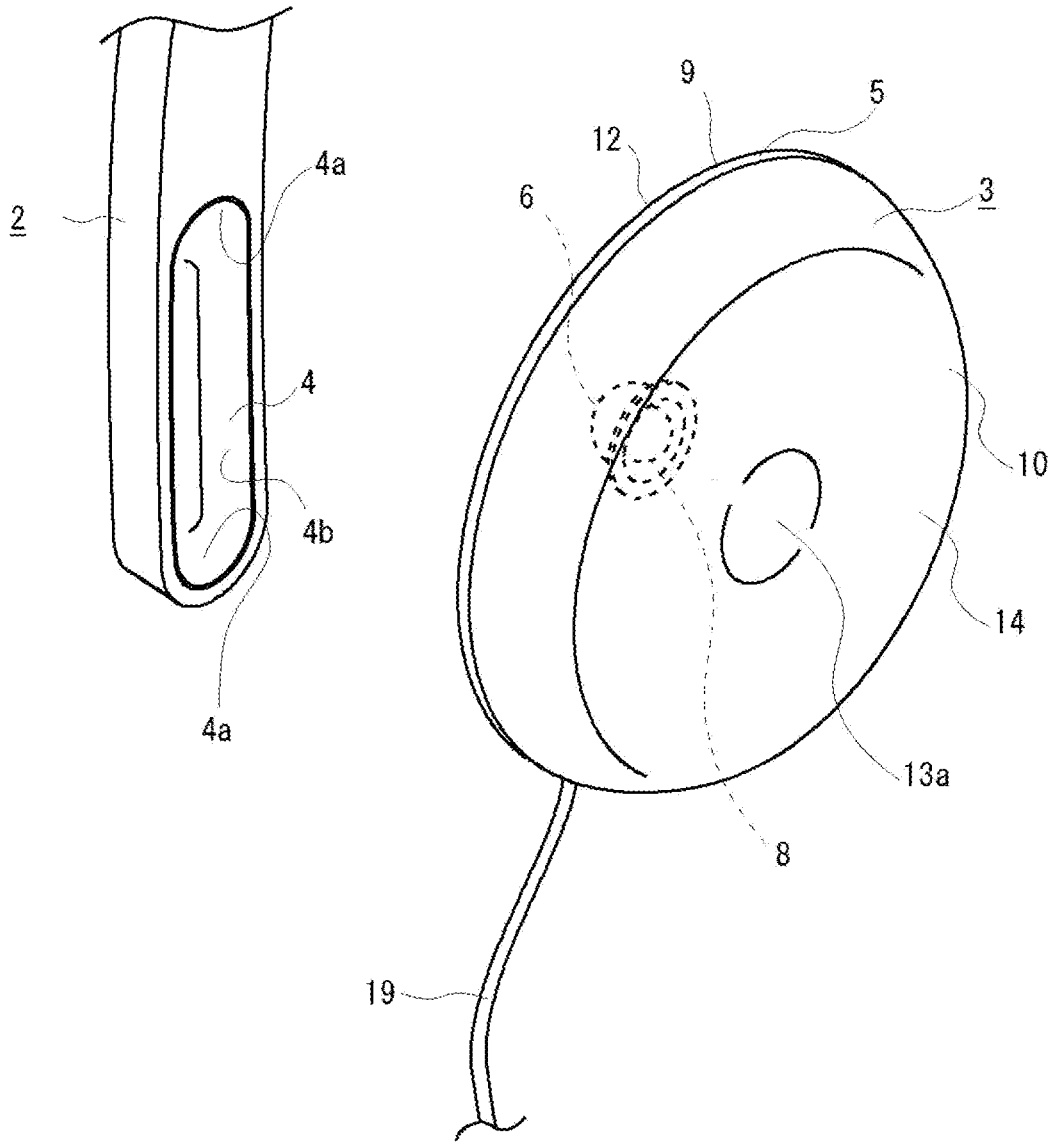
FIG. 3 is a perspective view of the headband and the speaker unit separated from each other, seen from a different direction from that in FIG. 2.
Figure 4:
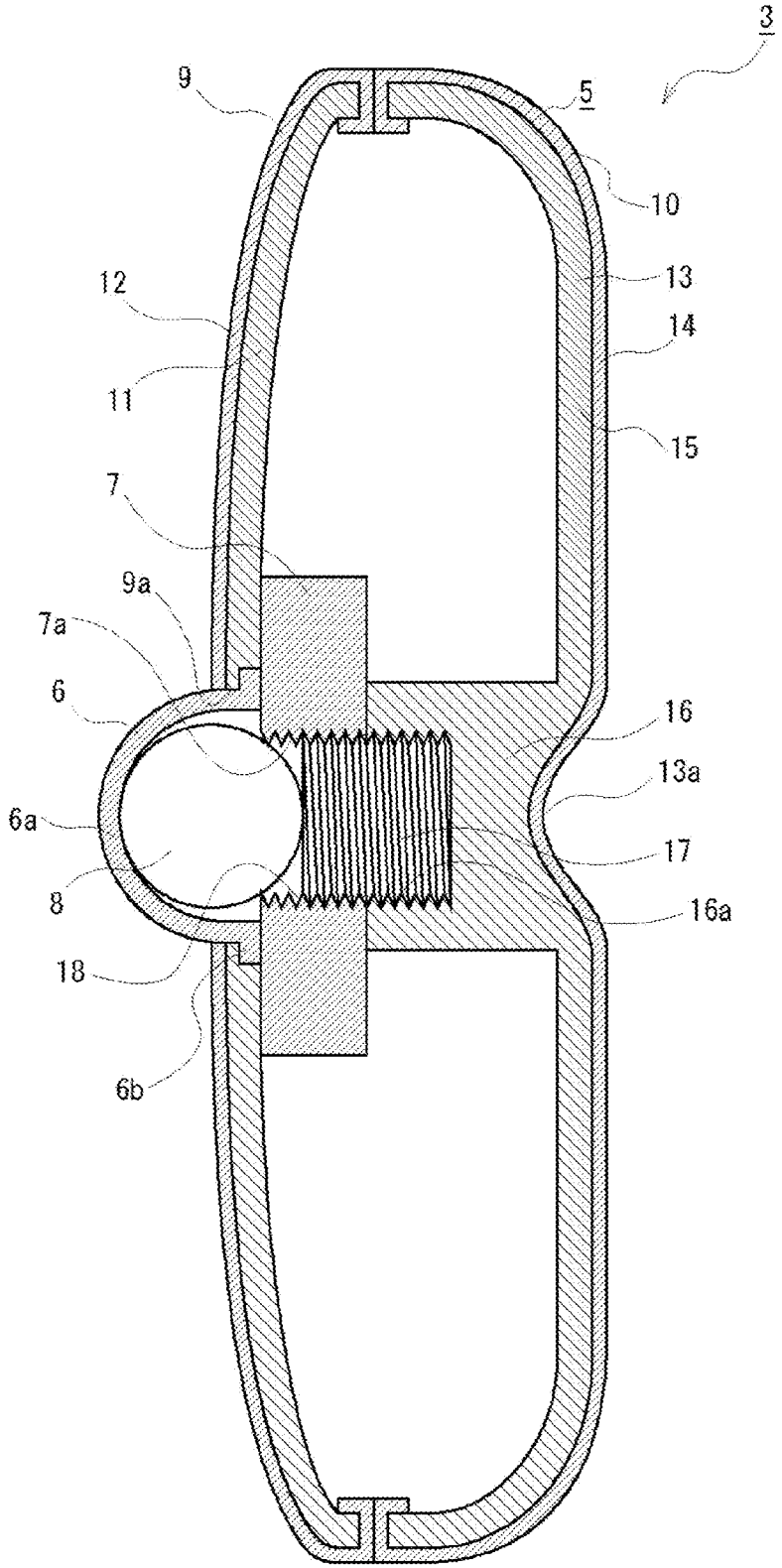
FIG. 4 is an enlarged cross-sectional view of a speaker unit.

The speaker units 3 each include an external housing 5, a to-be-sucked portion 6, an attachment portion 7, and a magnet 8 (see FIGS. 2 through 4).

The external housing 5 is formed by joining a cover portion 9 and an earmuff portion 10 together.

The cover portion 9 is formed with a base portion 11 and a protection sheet 12 attached to the base portion 11, and the protection sheet 12 is attached so as to spread from the outer surface to the periphery on the back surface side of the base portion 11 (see FIG. 4). A round insertion hole 9*a* is formed at the center of the cover portion 9. The base portion 11 is made of a plastic material such as resin, and the protection sheet 12 is made of a soft material such as polymeric fiber.

The earmuff portion 10 is formed with a casing portion 13 and an earmuff sheet 14 attached to the casing portion 13, and the earmuff sheet 14 is attached so as to spread from the outer surface to the periphery on the back surface side of the casing portion 13. A concave portion 13*a* is formed at the center of the casing portion 13. The casing portion 13 includes a shallow dish-like joining portion 15 that opens toward the side of the cover portion 9, and a protruding portion 16 that protrudes from the center of the joining portion 15 toward the side of the cover portion 9, with a screw hole 16*a* being formed at the top end portion of the protruding portion 16. The casing portion 13 is made of a plastic material such as resin, and the earmuff sheet 14 is made of a soft material such as polymeric fiber.

A column-shaped screw 17 is screwed and secured into the screw hole 16*a* of the protruding portion 16.

The to-be-sucked portion 6 is formed with a hemispherical ball holding portion 6*a* and a flange portion 6*b* that extends outward from the periphery of the ball holding portion 6*a*. The to-be-sucked portion 6 is made of a magnetic material such as iron. The to-be-sucked portion 6 has the ball holding portion 6*a* inserted into the insertion hole 9*a* of the cover portion 9, and has the flange portion 6*b* attached to the base portion 11. The ball holding portion 6*a* of the to-be-sucked portion 6 protrudes outward from the cover portion 9.

The attachment portion 7 is formed in a ring-like shape, and has a screw hole 7*a* at its center. The attachment portion 7 is attached to the center of the inner surface of the base portion 11.

The magnet 8 is formed in a ball-like shape having the same curvature as the curvature of the suction portion 4, and part of the magnet 8 is inserted into the to-be-sucked portion 6 while the remaining part of the magnet 8 is inserted into the screw hole 7*a*. The magnet 8 has the largest magnetic force generating point at its center. A magnetic force generated from the magnet 8 acts on the to-be-sucked portion 6.

In the above described structure, the screw 17 secured to the protruding portion 16 is screwed into the screw hole 7*a* of the attachment portion 7 from the opposite side from the magnet 8, so that the periphery of the earmuff portion 10 is joined to the periphery of the cover portion 9.

Cords 19 are connected to the speaker units 3 (see FIGS. 1 through 3). An audio output device (not shown) is incorporated into each external housing 5. Audio signals are input from a sound source to the audio output device via the cord 19.

[Attachment and Detachment of the Headband and the Speaker Units]

As described above, the speaker units 3 are detachably attached to the headband 2.

Figure 5:
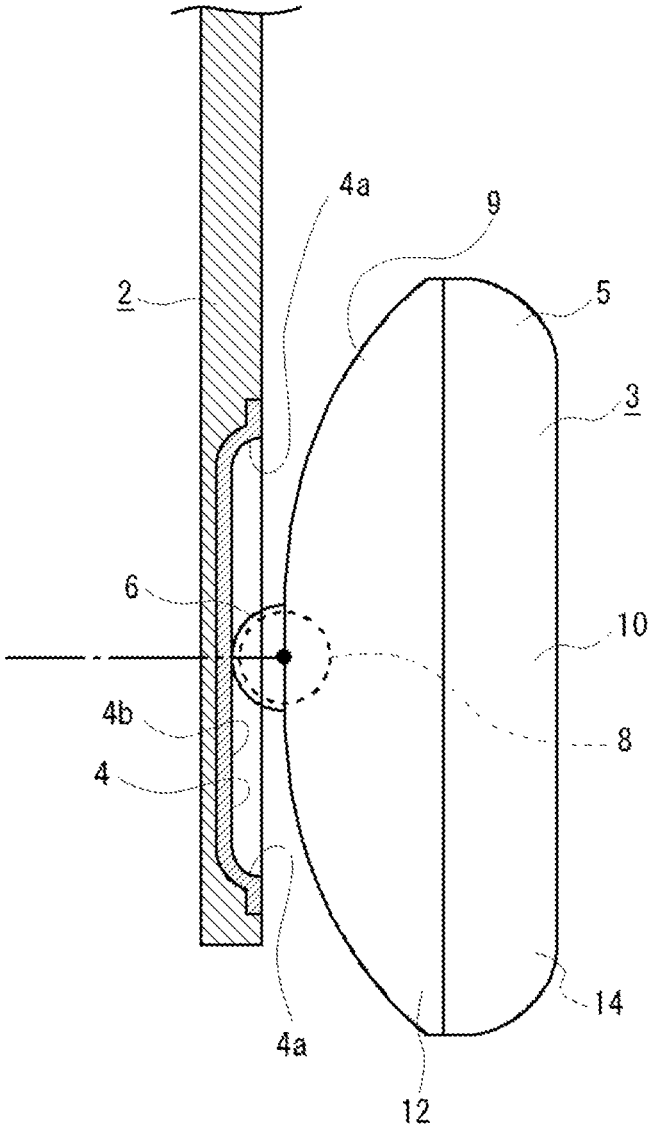
FIG. 5 is a cross-sectional view showing a situation where a to-be-sucked portion is sucked into a suction portion at a right angle.

Each speaker unit 3 is attached to the headband 2 by inserting the to-be-sucked portion 6 of the speaker unit 3 into a suction portion 4 of the headband 2 (see FIG. 5). At this point, the to-be-sucked portion 6 on which the magnetic force of the magnet 8 acts is sucked into the suction portion 4, so that the two portions are joined together. Since the to-be-sucked portion 6 is formed in a convex shape while the suction portion 4 is formed in a concave shape, the two portions joined together form a thin portion, and a stable connected state between the headband 2 and the speaker unit 3 can be secured.

Although each to-be-sucked portion 6 is formed in a convex shape while each suction portion 4 is formed in a concave shape in the above description, each to-be-sucked portion may be formed in a concave shape, and each suction portion may be formed in a convex shape. In this case, a stable connected state between the headband 2 and each speaker unit 3 can be secured. However, where the concave suction portions 4 are formed in the headband 2 while the convex to-be-sucked portions 6 are formed in the speaker units 3, the headband 2 can certainly have a smaller thickness.

Also, where each to-be-sucked portion is formed in a concave shape while each suction portion is formed in a convex shape, the to-be-sucked portions need to be longer in shape than the suction portions. However, the suction portions 4 formed in the headband 2 are preferably longer in shape than the to-be-sucked portions 6 formed in the speaker units 3. In this case, the longitudinal direction of the headband 2 formed to have a long shape beforehand is aligned with the longitudinal direction of the suction portions 4, so that the suction portions 4 can be formed without an increase in the size of the headphone device 1.

Also, as the outer surface of the ball holding portion 6*a* of each to-be-sucked portion 6 and the inner surface of each suction portion 4 have spherical or arc-like shapes with substantially the same curvature, the contact area between the two surfaces joined together is large, and an even more stable connected state can be secured.

Where the speaker units 3 are attached to the headband 2 in the above described manner, the speaker units 3 can be moved along the suction portions 4. Accordingly, the positions of the speaker units 3 relative to the headband 2 can be adjusted in accordance with the shape and the size of the head of the user and the positions of the ears relative to the head of the user, and the user-friendliness of the headphone device 1 can be increased.

Figure 6:
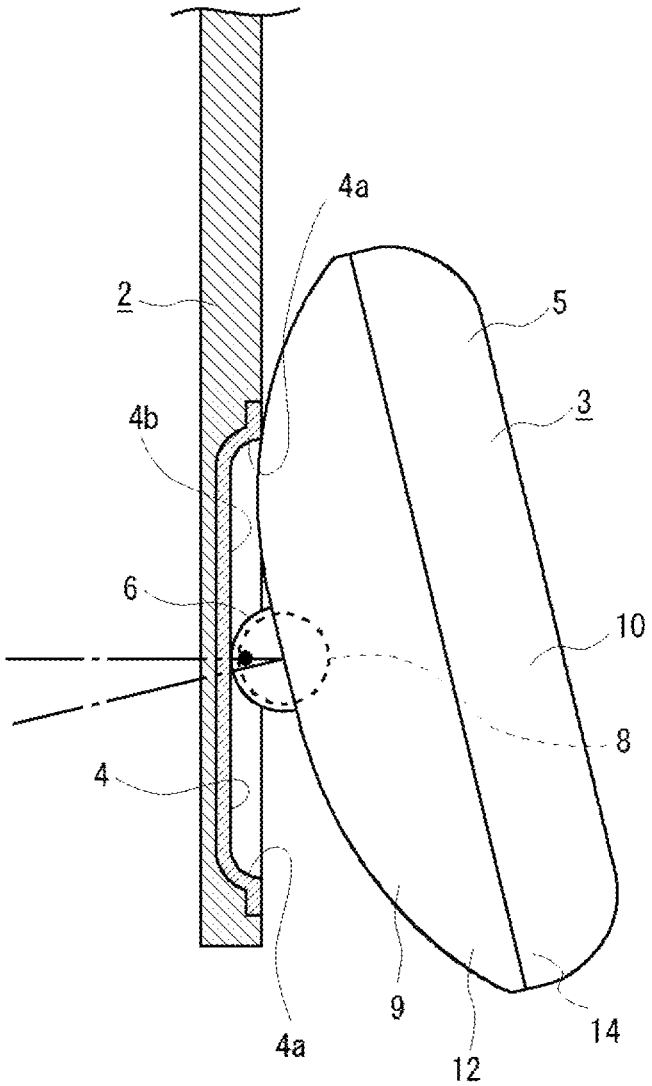
FIG. 6 is a cross-sectional view showing a situation where a speaker unit is attached while facing obliquely upward.
Figure 7:
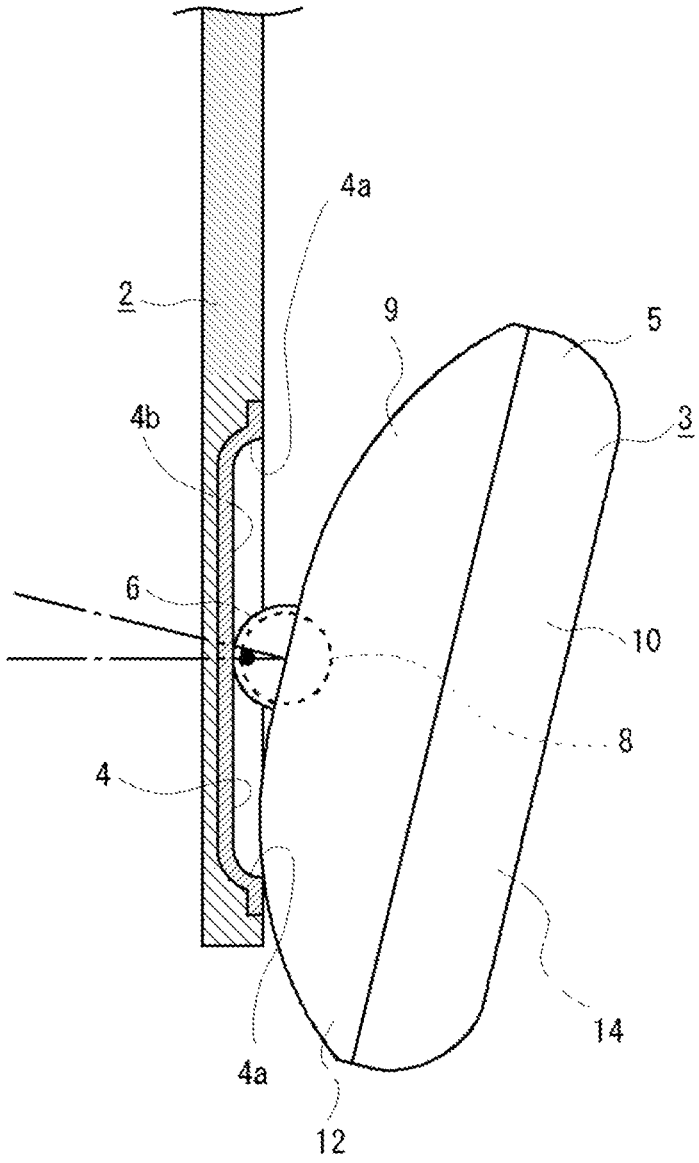
FIG. 7 is a cross-sectional view showing a situation where a speaker unit is attached while facing obliquely downward.

Each magnet 8 can have the largest magnetic force generating point at a portion other than its center. Where each magnet 8 has the largest magnetic force generating point at a portion other than its center, the to-be-sucked portions 6 are sucked into the suction portions 4 in such a manner that the speaker units 3 are attached not at a right angle but at an angle other than a right angle to the headband 2 (see FIGS. 6 and 7). For example, where each magnet 8 has the largest magnetic force generating point located above its center, the to-be-sucked portions 6 are sucked into the suction portions 4 in such a manner that the speaker units 3 are attached to the headband 2 while facing obliquely upward. Where each magnet 8 has the largest magnetic force generating point located below its center, on the other hand, the to-be-sucked portions 6 are sucked into the suction portions 4 in such a manner that the speaker units 3 are attached to the headband 2 while facing obliquely downward. Where each magnet 8 has the largest magnetic force generating point at a portion other than its center as described above, the speaker units 3 are rotated about the to-be-sucked portions 6 with respect to the headband 2, so that the speaker units 3 can be joined to the headband 2 at a desired angle.

As described above, the speaker units 3 can be attached to desired positions in the longitudinal direction of the suction portions 4. Furthermore, the speaker units 3 can be rotated and attached to the headband 2 at a desired angle, and the speaker units 3 can be finely adjusted in accordance with the shape and the size of the head of the user and the positions of the ears relative to the head of the user. Thus, even higher user-friendliness can be achieved.

[First Modification and Second Modification]

The following is a description of a first modification and a second modification of the suction portions and the to-be-sucked portions (see FIGS. 8 through 14).

The suction portions and the to-be-sucked portions according to the first modification and the second modification described below differ from the suction portions 4 and the to-be-sucked portions 6 described above only in including positioning concave portions or positioning convex portions. Therefore, only the different aspects from the suction portions 4 and the to-be-sucked portion 6 will be described in detail, and the other components are denoted by the same reference numerals as those denoting the corresponding components of the suction portion 4 and the to-be-sucked portions 6 and will not be explained below.

<First Modification>

First, the first modification is described (see FIGS. 8 through 12).

Figure 8:
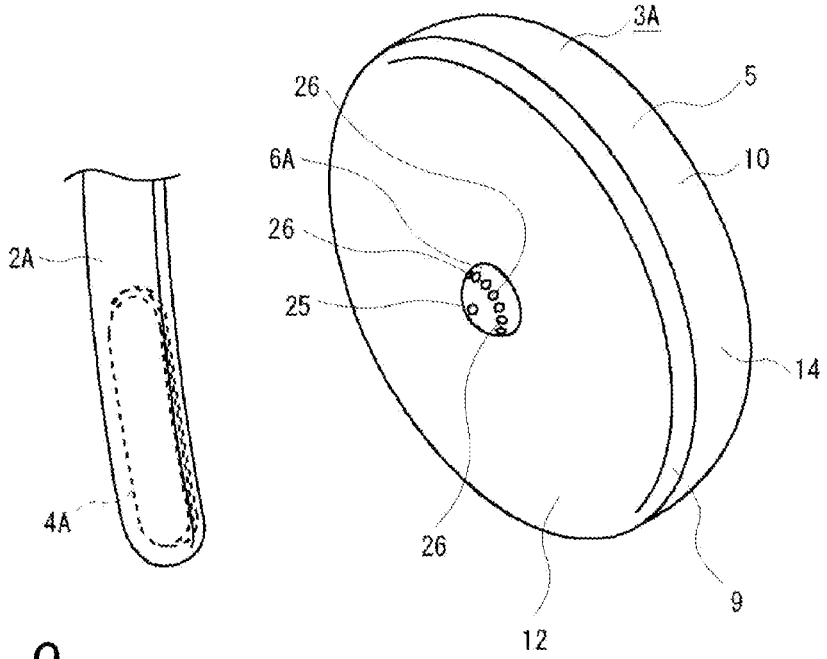
FIG. 8 is a perspective view of a headband and a speaker unit that are separated from each other, showing a first modification in conjunction with FIGS. 9 through 14.
Figure 9:
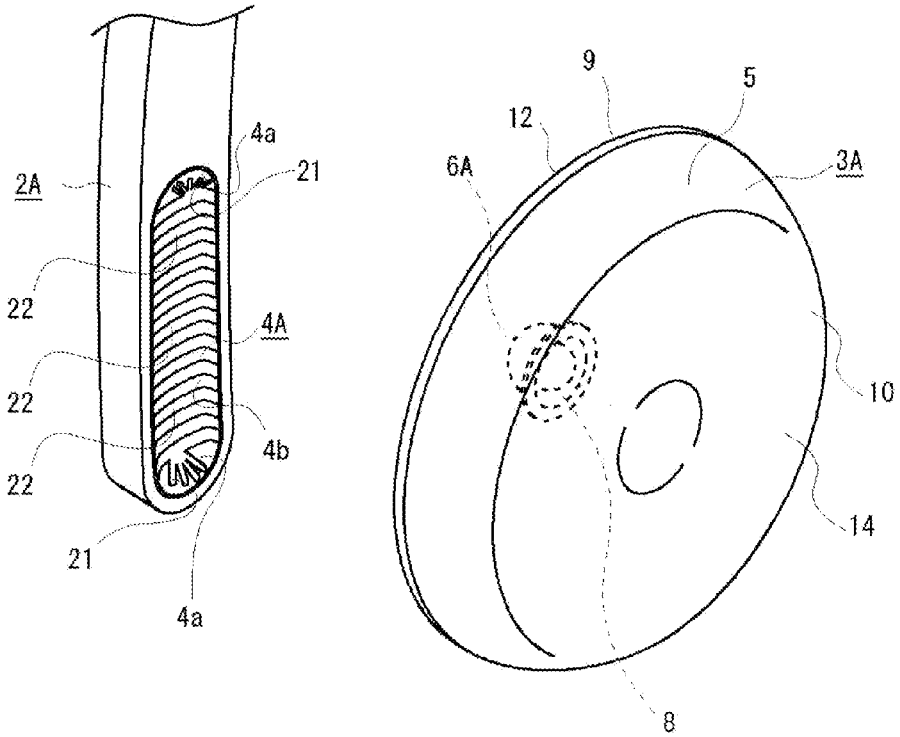
FIG. 9 is a perspective view of the headband and the speaker unit separated from each other, seen from a different direction from that in FIG. 8.

A headband 2A has suction portions 4A according to the first modification (see FIGS. 8 and 9). The headband 2A is the same as the headband 2, except for the structure of each suction portion 4A.

Figure 10:
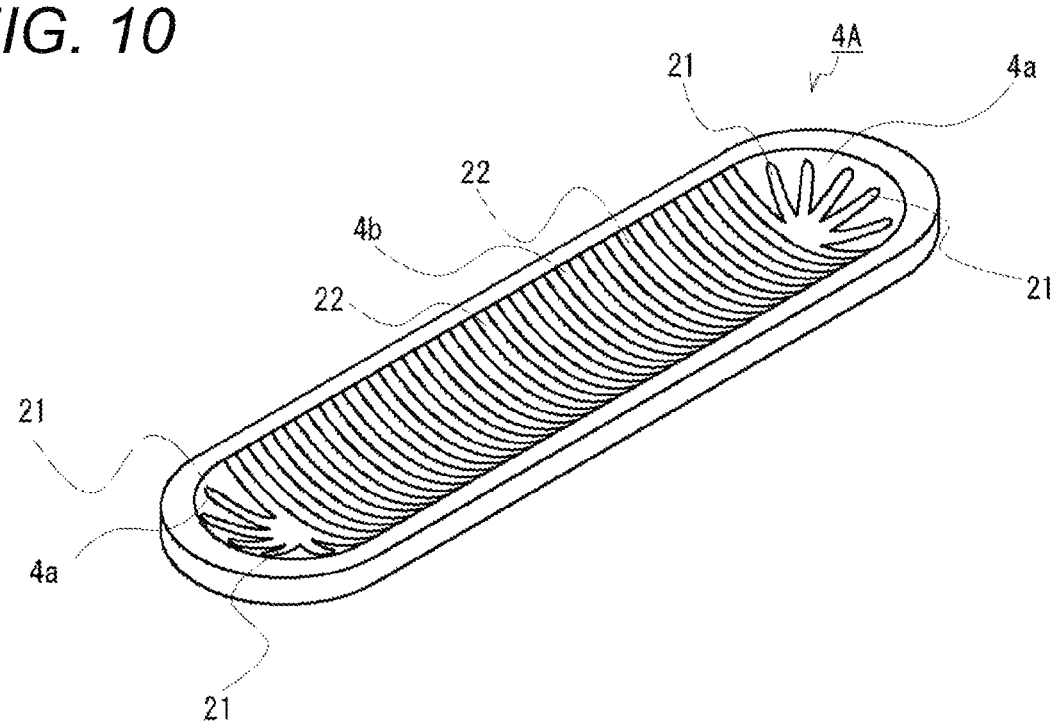
FIG. 10 is an enlarged perspective view of a suction portion.

At each end portion 4*a* of each suction portion 4A, first positioning concave portions 21 that extend in a radial direction are formed at intervals in a circumferential direction (see FIG. 10). At the intermediate portion 4*b* of each suction portion 4A, second positioning concave portions 22 that extend in the width direction (the short-side direction) are formed and arranged in the longitudinal direction.

Each speaker unit 3A has a to-be-sucked portion 6A according to the first modification (see FIGS. 8 and 9). The speaker units 3A are the same as the speaker units 3, except for the structure of each to-be-sucked portion 6A.

Figure 11:
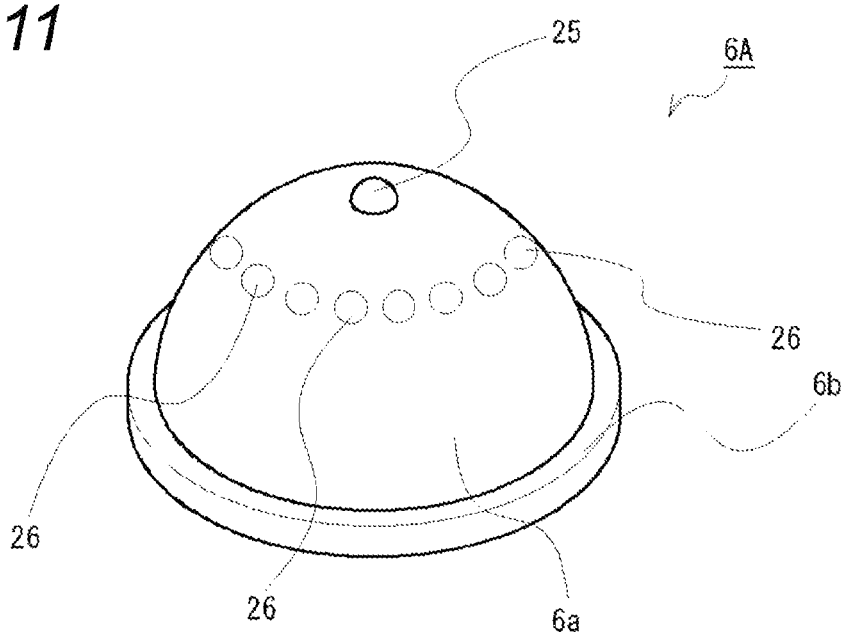
FIG. 11 is an enlarged perspective view of a to-be-sucked portion.
Figure 12:
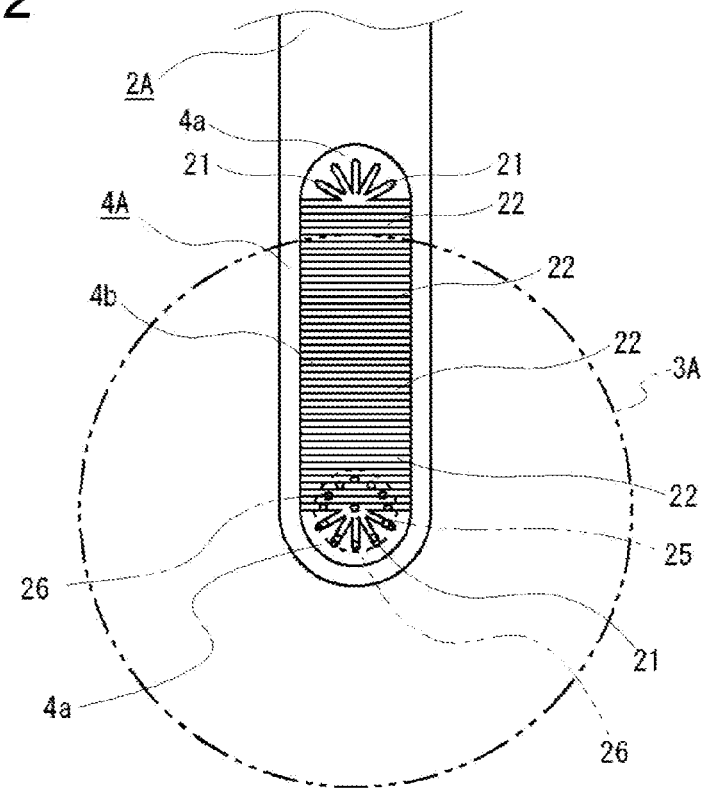
FIG. 12 is a side view showing a situation where a to-be-sucked portion is sucked into an end portion of a suction portion.
Figure 13:
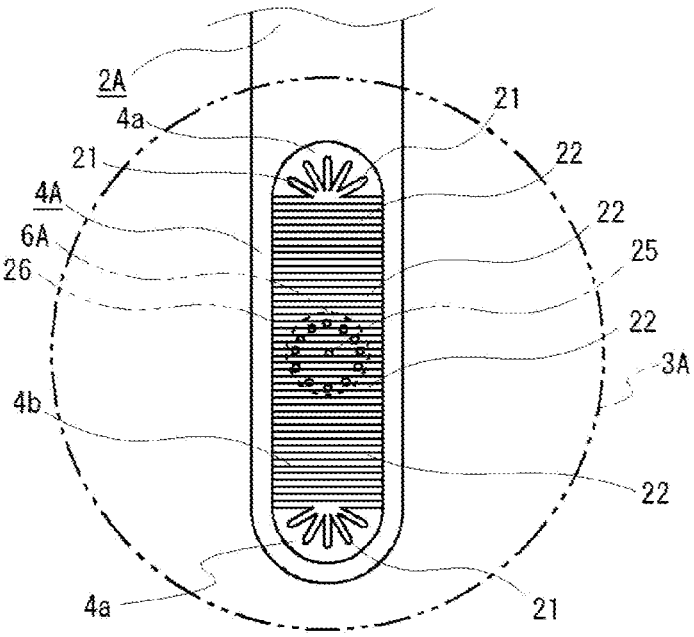
FIG. 13 is a side view showing a situation where a to-be-sucked portion is sucked into the intermediate portion of a suction portion.

At the ball holding portion 6*a* of each to-be-sucked portion 6A, a first positioning convex portion 25 and second positioning convex portions 26 are formed (see FIG. 11). The first positioning convex portion 25 is formed at the top of the ball holding portion 6*a*, and the second positioning convex portions 26 are formed around the first positioning convex portion 25 at the top and are arranged at intervals in a circumferential direction.

Where a to-be-sucked portion 6A is joined to an end portion 4*a* of a suction portion 4A in the headband 2A and the speaker units 3A having the above described structures, the first positioning convex portion 25 is inserted into a second positioning concave portion 22, and second positioning convex portions 26 are inserted into the first positioning concave portions 21 (see FIG. 12). Where a to-be-sucked portion 6A is joined to the intermediate portion 4*b* of a suction portion 4A, on the other hand, the first positioning convex portion 25 and the second positioning convex portions 26 are inserted into second positioning concave portions 22.

As described above, where a to-be-sucked portion 6A is joined to an end portion 4*a* of a suction portion 4A, the first positioning convex portion 25 and second positioning convex portions 26 are inserted and sucked into a second positioning concave portion 22 and the first positioning concave portions 21 (see FIG. 12). Where a to-be-sucked portion 6A is joined to the intermediate portion 4*b* of a suction portion 4A, the first positioning convex portion 25 and the second positioning convex portions 26 are inserted and sucked into second positioning concave portions 22 (see FIG. 13). Accordingly, stable positioning and connection of the speaker units 3A to the headband 2A can be secured.

Since the second positioning concave portions 22 are formed in the longitudinal direction in each suction portion 4A, the positions of the to-be-sucked portions 6A can be adjusted in the longitudinal direction while the to-be-sucked portions 6A are positioned to the respective suction portions 4A. Accordingly, the user-friendliness of the headphone device 1 can be increased.

Further, the first positioning convex portion 25 and the second positioning convex portions 26 are formed in each to-be-sucked portion 6A, and the first positioning concave portions 21 and the second positioning concave portions 22 are formed in each suction portion 4A. Accordingly, the positioning convex portions 25 and the second positioning convex portions 26 are inserted into first positioning concave portions 21 and second positioning concave portions 22, so that the to-be-sucked portions 6A are joined to the suction portions 4A.

As a result, the speaker units 3A do not rotate with respect to the suction portions 4A. Thus, the connection and the positioning between them can be stabilized.

<Second Modification>

Figure 14:
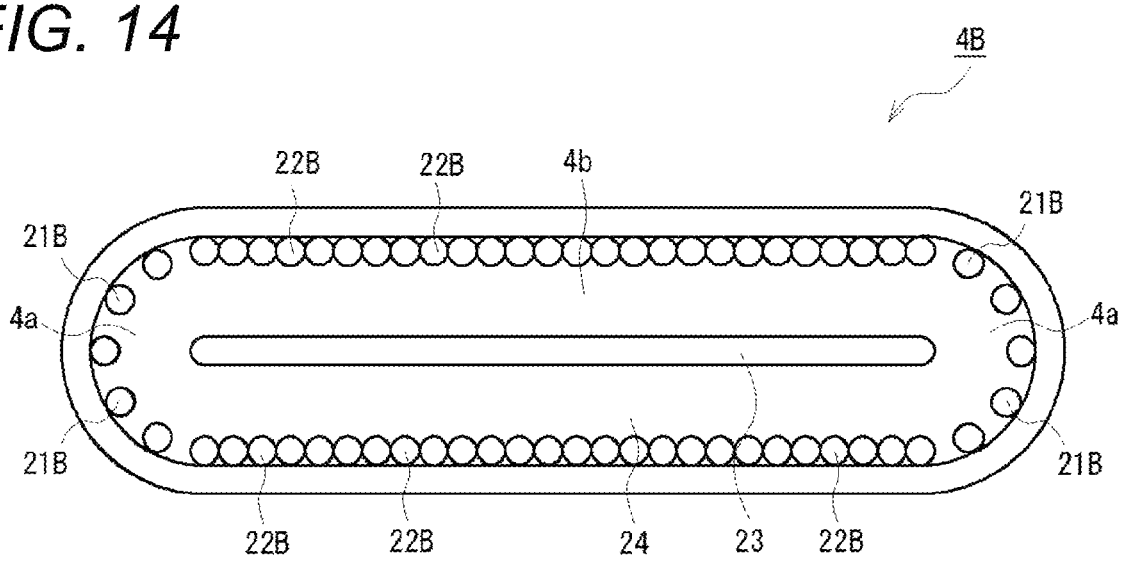
FIG. 14 is an enlarged plan view of a suction portion, showing a second modification in conjunction with FIG. 15.
Figure 15:
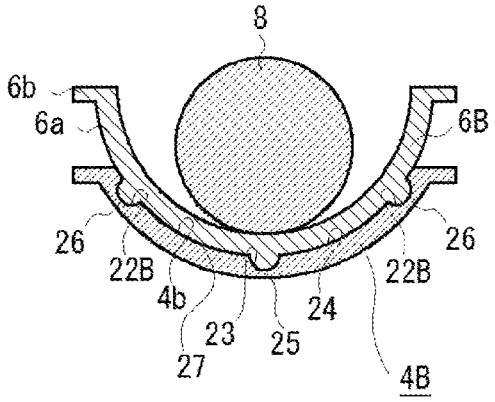
FIG. 15 is an enlarged cross-sectional view showing a situation where a to-be-sucked portion is sucked into a suction portion.

Next, the second modification is described (see FIGS. 14 and 15).

At the periphery of each end portion 4*a* of each suction portion 4B according to the second modification, first positioning concave portions 21B are formed at intervals in a circumferential direction (see FIG. 14). At the intermediate portion 4*b* of each suction portion 4B, second positioning concave portions 22B are formed at both end portions in the width direction (the short-side direction) and are arranged in the longitudinal direction. Further, at the intermediate portion 4*b* of each suction portion 4B, a third positioning concave portion 23 that extends in the longitudinal direction is formed at a central portion in the width direction. The portions of the end portions 4*a* and the intermediate portion 4*b* of each suction portion 4B other than the first positioning concave portions 21B, the second positioning concave portions 22B, and the third positioning concave portion 23 constitute a suction surface portion 24.

Each to-be-sucked portion 6B according to the second modification has the same shape as each to-be-sucked portion 6A. The portions of the ball holding portion 6*a* of each to-be-sucked portion 6 other than the first positioning convex portion 25 and the second positioning convex portions 26 constitute a to-be-sucked surface portion 27.

Where a to-be-sucked portion 6B is joined to an end portion 4*a* of a suction portion 4B, second positioning convex portions 26 are inserted into the first positioning concave portions 21B. At the same time, second positioning convex portions 26 are inserted into the second positioning concave portions 22B located at one end portion in the longitudinal direction, and the first positioning convex portion 25 is inserted into the one end of the third positioning concave portion 23. At this point, the to-be-sucked surface portion 27 is sucked to the suction surface portion 24 in a surface contact state (see FIG. 15).

Where a to-be-sucked portion 6B is joined to the intermediate portion 4*b* of a suction portion 4B, on the other hand, the first positioning convex portion 25 is inserted into the third positioning concave portion 23, and second positioning convex portions 26 are inserted into second positioning concave portions 22. At this point, the to-be-sucked surface portion 27 is sucked to the suction surface portion 24 in a surface contact state.

As described above, at the suction portions 4B and the to-be-sucked portions 6B, the to-be-sucked surface portions 27 are sucked to the suction surface portions 24 in a surface contact state. Accordingly, the suction force of the suction portions 4B for the to-be-sucked portions 6B becomes larger, and the connection and the positioning between them can be stabilized.

[Others]

Although the magnets 8 are placed on the sides of the to-be-sucked portions 6, 6A, and 6B in the above description, magnets may be placed on the sides of the suction portions 4, 4A, and 4B.

Where magnets are placed on the sides of the suction portions 4, 4A, and 4B, thin magnets are preferably selected in accordance with the thickness of the headband 2. It is also possible to place magnets on the sides of the suction portions 4, 4A, and 4B as well as on the sides of the to-be-sucked portions 6, 6A, and 6B.

The magnets 8 are placed on the sides of the to-be-sucked portions 6, 6A, and 6B, and each of the to-be-sucked portions 6, 6A, and 6B is formed in a convex shape. Accordingly, sufficient installation space can be secured for the magnets 8, and the headband 2 can be made thinner.

Although the positioning concave portions 21, 22, 21B, and 22B are formed in the suction portions 4 and 4A, and the positioning convex portions 25 and 26 are formed in the to-be-sucked portions 6A and 6B in the above description, positioning convex portions may be formed in the suction portions, positioning concave portions may be formed in the to-be-sucked portions, and positioning may be performed between them.

Figure 16:
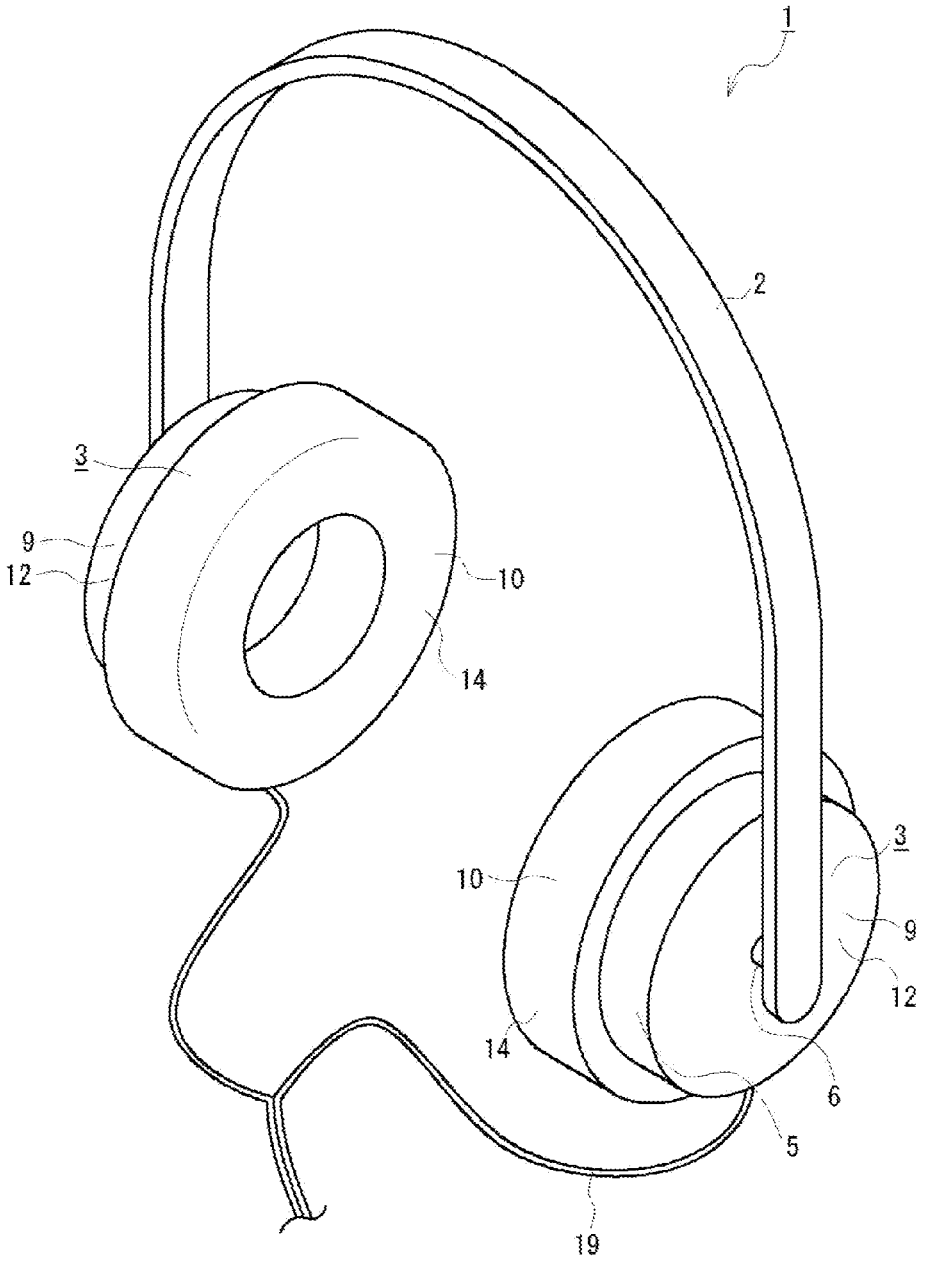
FIG. 16 is a perspective view of another example of speaker units.

Although the open-type speaker units 3 and 3A that do not cover the ears have been described as examples in the above description, it is possible to use so-called closed-type speaker units that cover the ears (see FIG. 16).

[Overview]

As described above, the headphone device 1 has a simple structure, as the to-be-sucked portions 6, 6A, and 6B are sucked into the suction portions 4, 4A, and 4B by virtue of magnetic forces from the magnets 8. When not being used, the speaker units 3 and 3A can be detached from the headband 2, and be put into a bag or the like separately from each other.

Accordingly, the structure can be simplified and be made easier to store, and portability of the structure can be increased.

[Present Technique]

The present technique may also be embodied in the structures described below.

(1) A headphone device including: a headband to be mounted on a head; and a pair of speaker units detachably attached to the headband, wherein a suction portion is formed in the headband, a to-be-sucked portion to be sucked into the suction portion by a magnetic force from a magnet is formed in the speaker units, and one of the suction portion and the to-be-sucked portion is longer in shape than the other one.

(2) The headphone device of (1), wherein the suction portion is longer in shape than the to-be-sucked portion, and the suction portion is designed to extend in the longitudinal direction of the headband.

(3) The headphone device of (1) or (2), wherein one of the suction portion and the to-be-sucked portion is formed in a convex shape, and the other one of the suction portion and the to-be-sucked portion is formed in a concave shape.

(4) The headphone device of (3), wherein the to-be-sucked portion is formed in a convex shape, and the suction portion is formed in a concave shape.

(5) The headphone device of any of (1) through (4), wherein the magnet is formed in a spherical shape, and the largest magnetic force generating point in the magnet is located at a portion other than the center of the magnet.

(6) The headphone device of any of (1) through (5), wherein the magnet is attached to the to-be-sucked portion.

(7) The headphone device of any of (1) through (6), wherein at least one positioning convex portion is formed in one of the suction portion and the to-be-sucked portion, and at least one positioning concave portion into which the at least one positioning convex portion is to be inserted is formed in the other one of the suction portion and the to-be-sucked portion.

(8) The headphone device of (7), wherein the at least one positioning concave portion includes positioning concave portions, and the positioning concave portions are formed in one of the suction portion and the to-be-sucked portion and are arranged in a longitudinal direction, the one of the suction portion and the to-be-sucked portion being long in shape.

(9) The headphone device of (7) or (8), wherein the at least one positioning convex portion includes positioning convex portions, and the positioning convex portions are inserted into the at least one positioning concave portion.

(10) The headphone device of any of (7) through (9), wherein a to-be-sucked surface portion is formed in a portion other than the at least one positioning convex portion in one of the suction portion and the to-be-sucked portion, and a suction surface portion to be brought into contact with the to-be-sucked surface portion is formed in a portion other than the at least one positioning concave portion in the other one of the suction portion and the to-be-sucked portion.

REFERENCE SIGNS LIST

1 . . . Headphone device, 2 . . . Headband, 3 . . . Speaker unit, 4 . . . Suction portion, 6 . . . To-be-sucked portion, 8 . . . Magnet, 2A . . . Headband, 3A . . . Speaker unit, 4A . . . Suction portion, 6A . . . To-be-sucked portion, 21 . . . First positioning concave portion, 22 . . . Second positioning concave portion, 25 . . . First positioning convex portion, 26 . . . Second positioning convex portion, 4B . . . Suction portion, 6B . . . To-be-sucked portion, 21B . . . First positioning concave portion, 22B . . . Second positioning concave portion, 23 . . . Third positioning concave portion, 24 . . . Suction surface portion, 27 . . . To-be-sucked surface portion

The invention claimed is:

1. A headphone device comprising: a headband to be mounted on a head; and a pair of speaker units detachably attached to the headband, wherein a suction portion is formed in the headband, a to-be-sucked portion to be sucked into the suction portion by a magnetic force from a magnet is formed in the speaker units, and one of the suction portion and the to-be-sucked portion is longer in shape than the other one of the suction portion and the to-be-sucked portion.

2. The headphone device according to claim 1, wherein the suction portion is longer in shape than the to-be-sucked portion, and the suction portion is designed to extend in a longitudinal direction of the headband.

3. The headphone device according to claim 1, wherein one of the suction portion and the to-be-sucked portion is formed in a convex shape, and the other one of the suction portion and the to-be-sucked portion is formed in a concave shape.

4. The headphone device according to claim 3, wherein the to-be-sucked portion is formed in a convex shape, and the suction portion is formed in a concave shape.

5. The headphone device according to claim 1, wherein the magnet is formed in a spherical shape, and a largest magnetic force generating point in the magnet is located at a portion other than the center of the magnet.

6. The headphone device according to claim 1, wherein the magnet is attached to the to-be-sucked portion.

7. The headphone device according to claim 1, wherein at least one positioning convex portion is formed in one of the suction portion and the to-be-sucked portion, and at least one positioning concave portion into which the at least one positioning convex portion is to be inserted is formed in the other one of the suction portion and the to-be-sucked portion.

8. The headphone device according to claim 7, wherein the at least one positioning concave portion comprises a plurality of positioning concave portions, and the positioning concave portions are formed in one of the suction portion and the to-be-sucked portion and are arranged in a longitudinal direction, the one of the suction portion and the to-be-sucked portion being long in shape.

9. The headphone device according to claim 7, wherein the at least one positioning convex portion comprises a plurality of positioning convex portions, and the positioning convex portions are inserted into the at least one positioning concave portion.

10. The headphone device according to claim 7, wherein a to-be-sucked surface portion is formed in a portion other than the at least one positioning convex portion in one of the suction portion and the to-be-sucked portion, and a suction surface portion to be brought into contact with the to-be-sucked surface portion is formed in a portion other than the at least one positioning concave portion in the other one of the suction portion and the to-be-sucked portion.

* * * * *